US005595093A

United States Patent [19]

Kapolnek

[11] Patent Number: 5,595,093

[45] Date of Patent: Jan. 21, 1997

[54] METHOD OF FORMING A ROTARY CUTTING DIE

[75] Inventor: Paul G. Kapolnek, Chicago, Ill.

[73] Assignee: Western Printing Machinery Company, Schiller Park, Ill.

[21] Appl. No.: 241,618

[22] Filed: May 12, 1994

[51] Int. Cl.[6] ..... B26F 1/44

[52] U.S. Cl. ..... 76/107.8; 76/4; 76/DIG. 7; 83/670; 83/674; 83/698.41

[58] Field of Search ..... 76/4, 107.8, DIG. 7; 83/670, 673, 674, 696, 698.41, 698.42; 30/346

[56] References Cited

U.S. PATENT DOCUMENTS

| | | | |
|---|---|---|---|
| 3,383,969 | 5/1968 | Saunders | 83/663 |
| 3,598,010 | 8/1971 | Chambon | 83/675 |
| 3,698,028 | 10/1972 | Panter et al. | 83/656 |
| 3,747,458 | 7/1973 | Brown | 83/520 |
| 3,789,715 | 2/1974 | Schuchardt et al. | 83/663 |
| 3,805,657 | 4/1974 | Simpson | 83/522 |
| 3,941,038 | 3/1976 | Bishop | 493/371 |
| 4,103,580 | 8/1978 | Sauer et al. | 83/663 |
| 4,248,117 | 2/1981 | Bugnone | 83/863 |
| 4,878,407 | 11/1989 | Harrison et al. | 83/13 |

*Primary Examiner*—Rinaldi I. Rada
*Assistant Examiner*—Raymond D. Woods
*Attorney, Agent, or Firm*—Brinks Hofer Gilson & Lione

[57] ABSTRACT

A method of forming a rotary cutting die includes the following steps. A curved cutting rule transfer plate including an inner surface and an outer surface is provided. A cutting rule channel is formed in the transfer plate, and defines a predetermined design. A cutting rule having a cutting edge and a support edge is placed in the cutting rule channel. The support edge of the cutting rule extends from the inner surface of the transfer plate. A translucent rotary die place is formed on the inner surface of the transfer plate. The support edge of the cutting rule extends into and is supported in the rotary die plate. The transfer plate is then removed from the rotary die plate.

12 Claims, 6 Drawing Sheets

Fig. 8
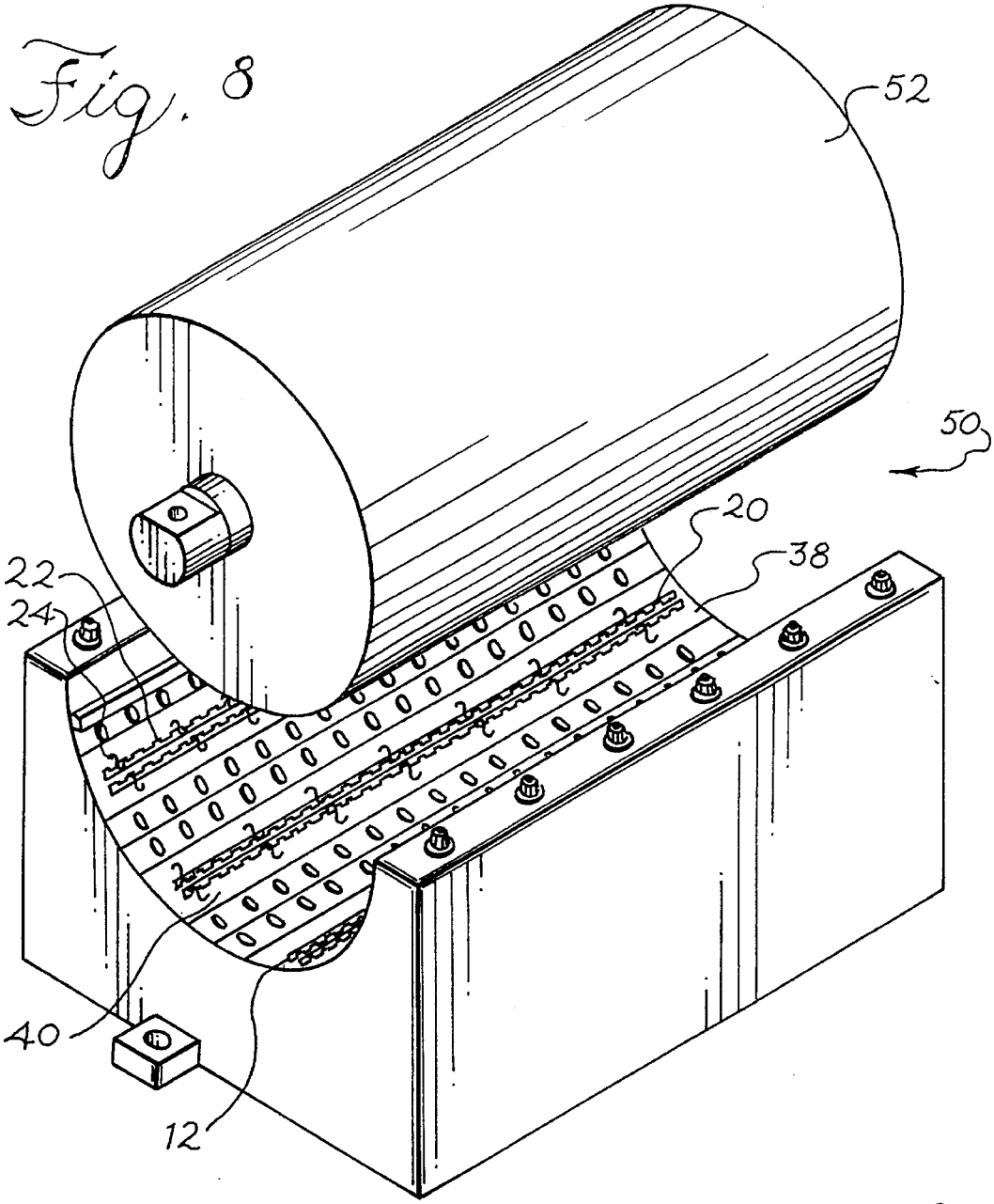
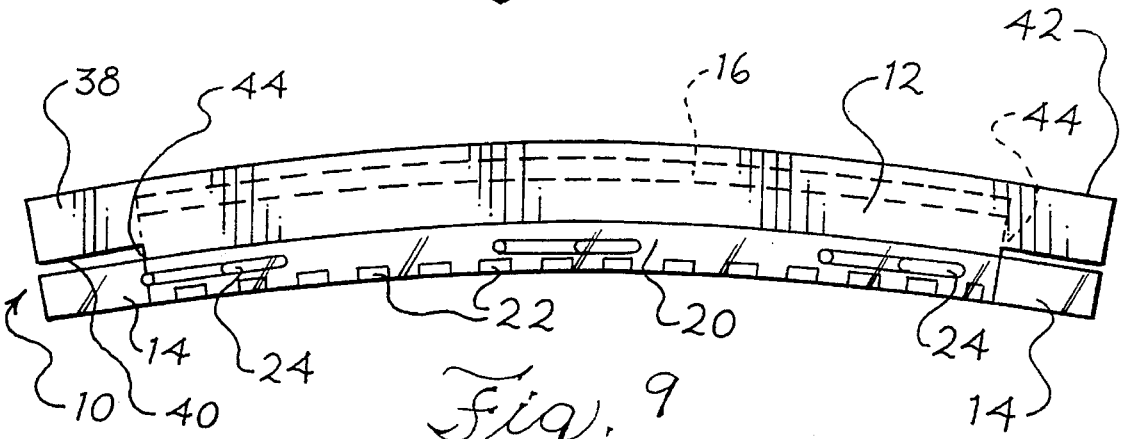
Fig. 9

METHOD OF FORMING A ROTARY CUTTING DIE

BACKGROUND OF THE INVENTION

The present invention relates generally to the field of rotary cutting dies, and more particularly to an improved method and apparatus for making and using such dies.

Rotary cutting dies have been manufactured and used for numerous years. Conventionally, rotary cutting dies are formed from an opaque, resinous die plate material supporting a metallic cutting rule. The cutting rule extends above the surface of the resin die plate and defines a cutting design. The design created by the metallic cutting rule is employed to cut, score or perforate material, such as paper, cardboard or the like, through the rotary cutting process.

Usually, rotary cutting dies are sized to be mounted either on discrete sections of a rotary cutting machine die cylinder or along the entire surface thereof. To accommodate either type of die, the die cylinder typically contains a number of receiving holes spaced at pre-determined intervals. The receiving holes are positioned in an array along the die cylinder, and are configured to receive screws or other fasteners that extend through the die to affix the die to the die cylinder. Mounting holes are bored into the cutting die to align with the receiving holes in the die cylinder. The rotary cutting die is thus aligned and positioned on the die cylinder to reflect the predetermined pattern for the cutting, scoring or perforating process.

Because the die plate of the rotary cutting die is normally formed from an opaque material, the precise hole placement required to properly mount and align the cutting die on the die cylinder cannot be readily determined and must be obtained by approximation or guess. In an attempt to solve this alignment problem, a guide bar, having guide holes spaced along its longitudinal axis to match the spacing of the receiving holes in the die cylinder, has been used. The guide bar is placed along the top surface of a rotary cutting die while the cutting die is held in place over the die cylinder. The guide bar is extended across the cutting die and the die cylinder to indicate the position of the receiving holes beneath the cutting die provided in the die cylinder. By aligning the guide holes in the guide bar with the receiving holes in the die cylinder, the position of the mounting holes required to be bored or drilled into the cutting die can be more easily determined. Subsequently, the mounting holes are drilled in the cutting die and the cutting die is mounted on the die cylinder, as described above. While the guide bar has produced satisfactory results, inaccuracies in locating the receiving holes still frequently occur.

Inaccurate alignment and positioning of mounting holes may be occasionally remedied by re-drilling or otherwise forming the holes without unduly affecting or jeopardizing the integrity of the cutting die. Often, however, inaccurate mounting hole positioning in the cutting die results in the cutting die being ruined, necessitating a new cutting die being formed. When cutting dies are scrapped, significant overhead costs and down time are incurred. Moreover, inaccurate mounting hole positioning increases production costs and lowers plant productivity.

SUMMARY OF THE INVENTION

In view of the above, the present invention provides a unique method and apparatus for quickly and easily mounting rotary cutting dies to die cylinders, thereby reducing the number and incidence of scrapped dies caused by poorly positioned mounting holes. According to the invention, a transparent or translucent material is used to form the die plate. Using a transparent or translucent die plate material allows the ready observation and detection of the receiving holes in the die cylinder so that corresponding mounting holes can be defined in the cutting die to allow secure mounting of the die to the cylinder.

According to a first aspect of the invention, a method is provided for forming a rotary cutting die using a transparent or translucent die plate material. The method includes providing a curved cutting rule transfer plate, having an inner surface and an outer surface, and forming a cutting rule channel in the transfer plate. Next, a cutting rule, having a cutting edge and a support edge, is placed in the cutting rule channel. A translucent rotary die plate is then formed on the inner surface of the transfer plate, and the transfer plate is removed from the rotary die plate.

According to a second aspect of the invention, a method is provided for rotary die perforating, cutting, or scoring using a transparent or translucent rotary die plate. The method includes providing a rotary cutting die, having a curved, translucent rotary die plate and a cutting rule supported in the rotary die plate. The rotary die plate is mounted on a die cylinder of a rotary cutting machine by means of a plurality of fasteners extending through mounting holes disposed in the rotary die plate. The plurality of fasteners mount into receiving holes positioned along the die cylinder. A material is then fed between the die cylinder and an opposing cylinder to be cut, scored or perforated by the cutting rule in the pattern of the design.

According to a third aspect of the invention, a rotary cutting die is provided that includes a translucent rotary die plate having an inner surface and an outer surface. A cutting rule, defining a predetermined design, and a plurality of interlocking connectors connected to the cutting rule, are also provided. The interlocking connectors cooperate to secure and support the cutting rule in the rotary die plate. In a preferred embodiment of the invention, the comprise S-shaped hooks that couple to key-hole shaped openings defined in the cutting rule beneath the outer surface of the die plate.

According to a fourth aspect of the invention, a rotary cutting machine is provided that includes a die cylinder, a rotary cutting die mounted on the die cylinder, and an opposing cylinder positioned parallel to and in opposite rotary relationship with the die cylinder. The rotary cutting die includes a translucent rotary die plate having an inner surface and an outer surface. A cutting rule defining a design, and having a cutting edge and a support edge, is supported in the rotary die plate. The opposing cylinder and the cutting rule supported in the rotary die plate cooperate to cut, score or perforate a material in the pattern of the design.

The present invention provides a rotary cutting die having a die plate formed from a translucent or transparent material. According to a preferred embodiment of the invention, this material consists of an epoxy or like substance that exhibits a low shrink factor upon hardening. The translucent or transparent die plate allows for the accurate and precise positioning of mounting holes in the die plate, which holes can be aligned with receiving holes disposed in the rotary cutting machine die cylinder. Because the die plate is translucent, the present invention eliminates the need for the prior guide bar or the like, and reduces the make ready time and scrapping of cutting dies caused by inaccurate mounting hole alignment and positioning.

These and other features and advantages of the present invention will become apparent to those skilled in the art upon review of the following detailed description of the presently preferred embodiments of the invention taken in conjunction with the accompanying drawings.

BRIEF DESCRIPTION OF THE DRAWINGS

FIG. 8 is a partially exploded perspective view of a rotary cutting die mold; and FIG. 9 is a side view of the rotary cutting die and transfer plate after being removed from the rotary cutting die mold shown in FIG. 8.

DETAILED DESCRIPTION OF THE PRESENTLY PREFERRED EMBODIMENTS

Figure 1:
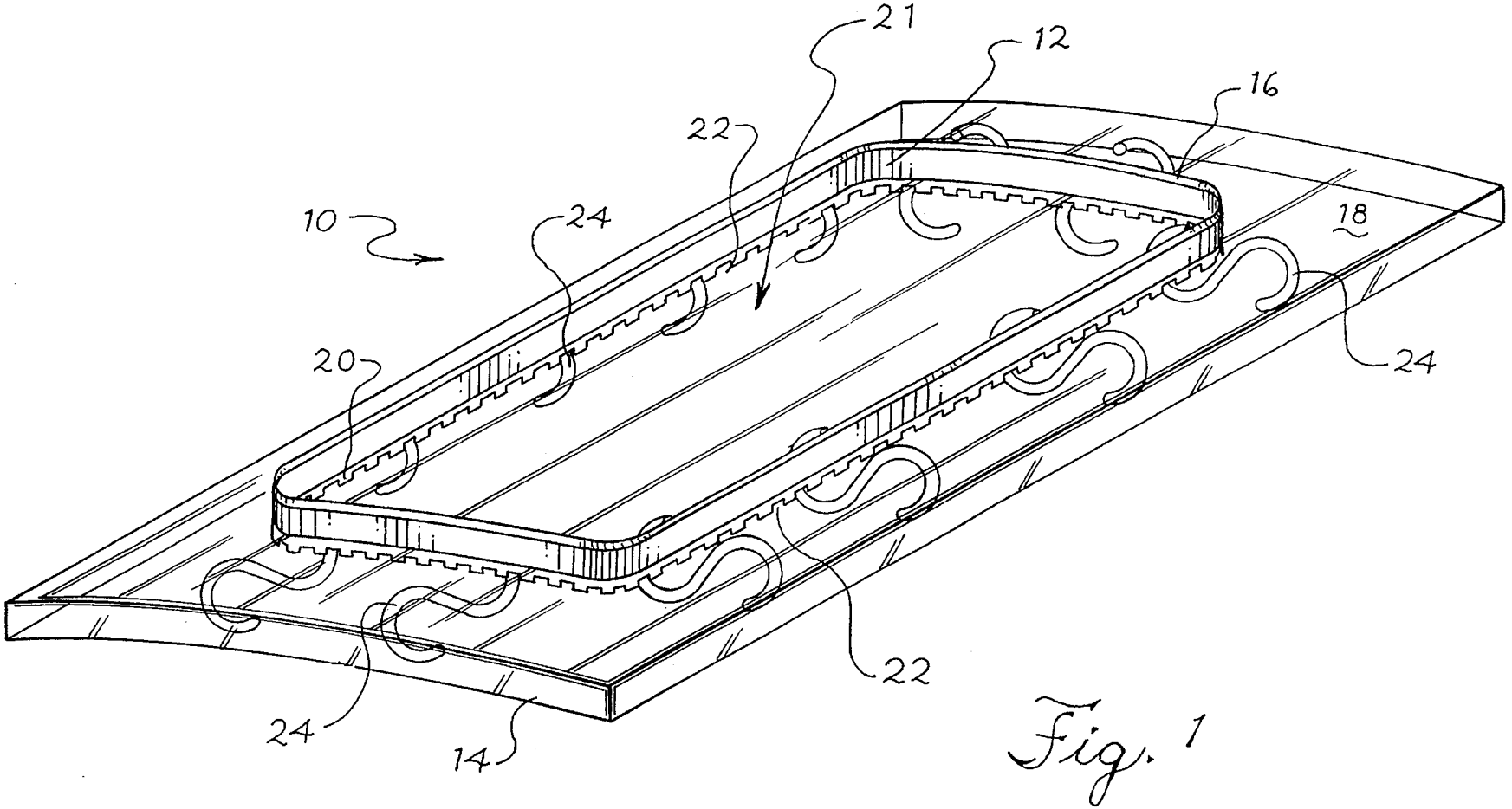
FIG. 1 is a perspective view of a rotary cutting die of the invention having a cutting rule supported therein.
Figure 2:
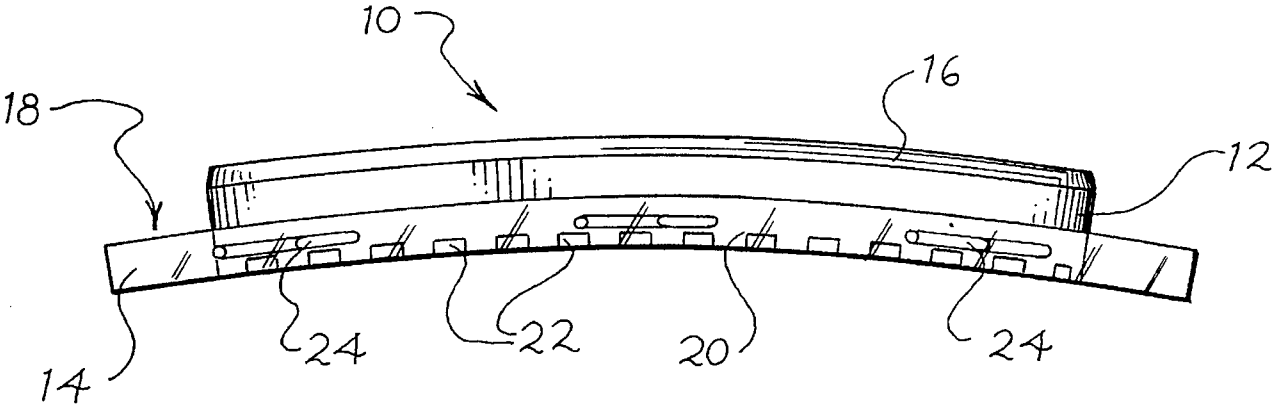
FIG. 2 is a side view of the rotary cutting die shown in FIG. 1.

Referring now to the drawings, FIGS. 1 and 2 show the preferred embodiment of the rotary cutting die 10 of the present invention. The rotary cutting die 10 includes a cutting rule 12 supported in a translucent or transparent rotary die plate 14. The cutting rule 12 has a cutting edge 16, which extends above the outer surface 18 of the rotary die plate 14, and a support edge 20 disposed within the rotary die plate 14. The cutting rule 12 forms a predetermined cutting design 21 on the rotary cutting die 10.

The cutting edge 16 of the cutting rule 12 is preferably sharp to enable it to cut, score or perforate the design 21 into a given cutting material (not shown). Preferably, the cutting edge 16 extends approximately ⅛" above the outer surface 18 of the rotary die plate 14. However, as those skilled in the art will appreciate, the cutting edge 16 can extend to any distance dictated by a specific application without departing from the spirit and scope of the invention.

Figure 3:
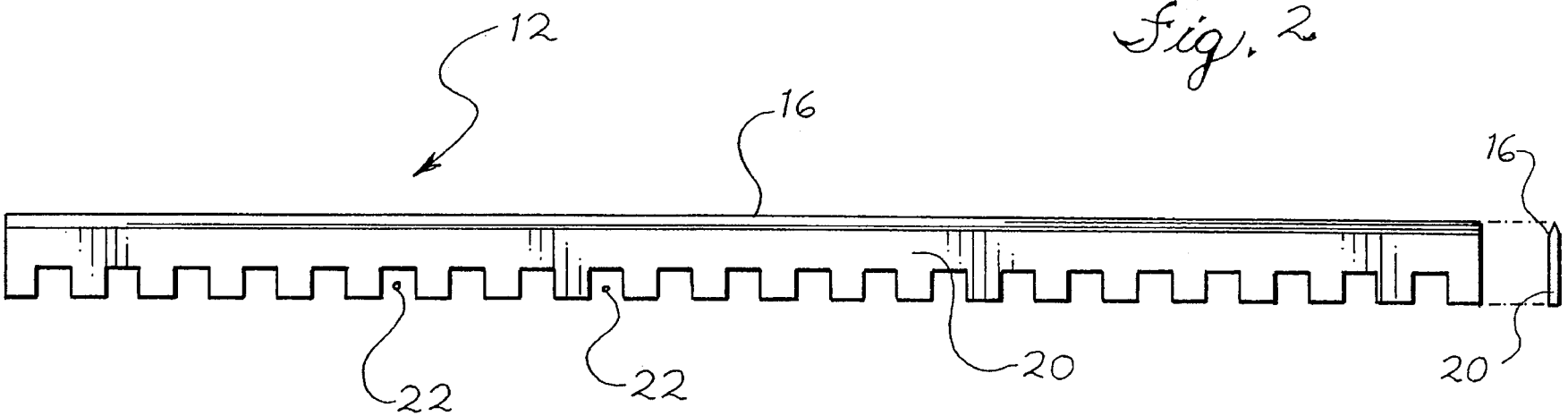
FIG. 3 is a side view of the cutting rule shown in FIGS. 1 and 2, including an end view thereof.

As best shown in FIG. 3, the support edge 20 preferably includes a plurality of notches 22. As shown in FIGS. 1 and 2, the notches 22 are connected to a plurality of interlocking connectors 24 disposed throughout the rotary die plate 14. The interlocking connectors 24 serve both to reinforce the rotary die plate 14 and to secure the cutting rule 12 in the rotary die plate 14. Preferably, as shown, the notches 22 are key-hole shaped notches and the interlocking connectors 24 are S-shaped hooks. As those skilled in the art will appreciate, other shapes for the notches 22 and the interlocking connectors 24 can be employed and are contemplated.

The rotary die plate 14, as best shown in FIGS. 1 and 2, may be formed of any suitable translucent or transparent material and to any suitable thickness. Preferably, the rotary die plate 14 is formed of an epoxy-based material that exhibits a low shrink factor upon hardening. The low shrink factor is desired to ensure that the design 21 formed by the cutting rule 12 is not skewed when the die plate 14 is formed, and to ensure that the required shape of the die plate 14 is retained. The rotary die plate 14 is also preferably between 1/32" to ⅛" thick, although other thicknesses dictated by particular uses for the rotary cutting die 10 are contemplated.

Figure 4:
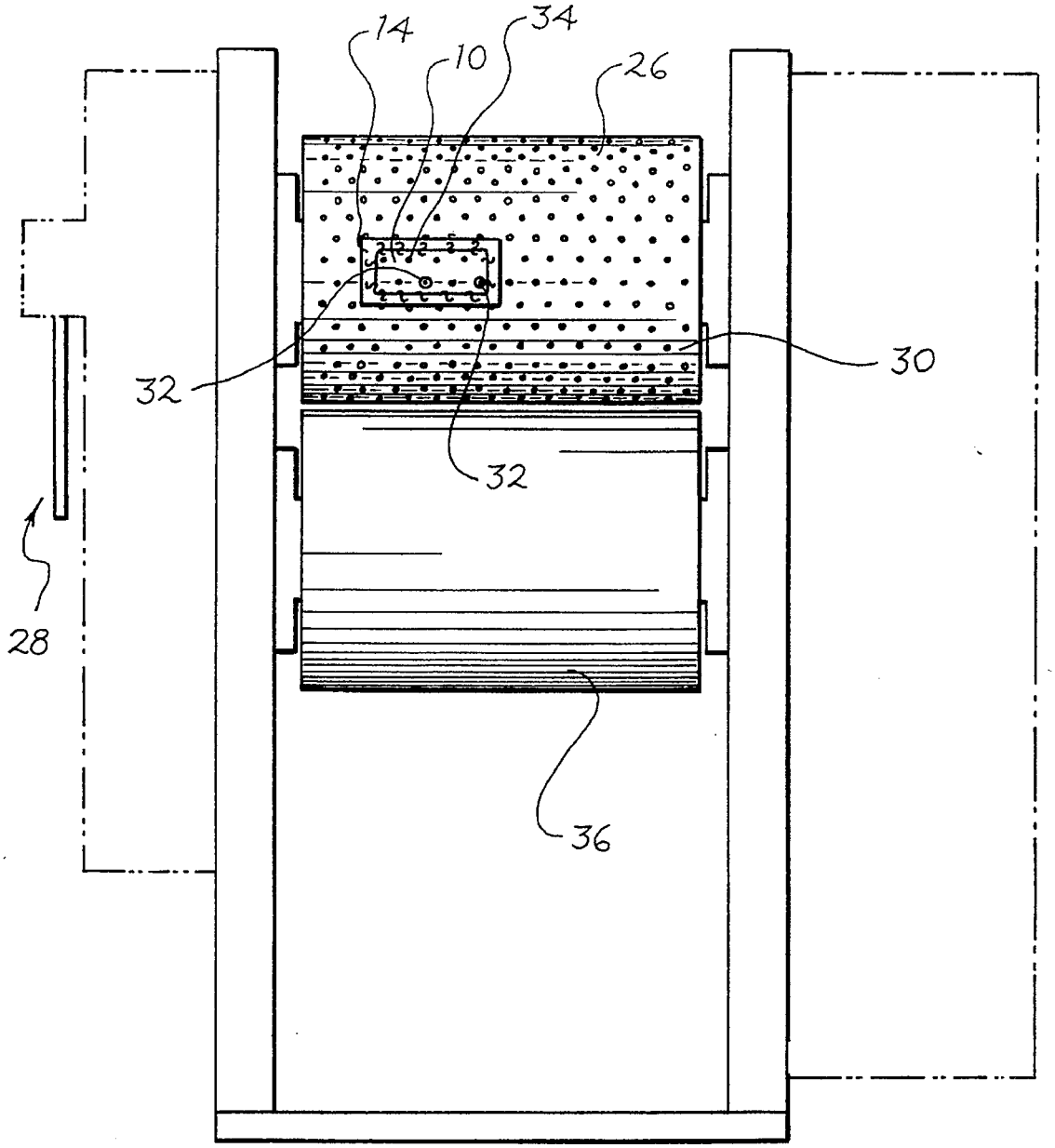
FIG. 4 is a front plan view of a rotary cutting machine including the rotary cutting die shown in FIGS. 1 and 2 mounted thereon.

Referring now to FIG. 4, the rotary cutting die 10 is preferably sized for use on a discrete section of a die cylinder 26 of a rotary cutting machine 28. Alternately, however, the rotary cutting die 10 may be sized to cover all, or a substantial portion, of the die cylinder 26, and numerous individual rotary cutting dies may be mounted on the die cylinder 26. To properly fit on the die cylinder 26, the radius of curvature of the rotary cutting die 10 should match that of the die cylinder 26.

The preferred die cylinder 26 contains a plurality of receiving holes 30 positioned in a uniform matrix or array about its outer surface, as shown in FIG. 4. The rotary die 10 is mounted on the die cylinder 26 by means of a plurality of fasteners 32 disposed through mounting holes 34 located in the rotary die plate 14 of the die 10. The fasteners 32 are secured within the receiving holes 30 in the die cylinder 26 to mount the rotary die plate 14 of the rotary die 10 to the die cylinder 26. Any suitable form of fastener may be utilized to secure the rotary die 10 on the die cylinder 26. In one preferred embodiment of the invention, the fasteners 32 comprise screws, or the like, that turn into the preferably threaded receiving holes 30 in the die cylinder 26.

Because the rotary die plate 14 is preferably translucent or transparent, the required positioning of the mounting holes 34 in the die plate 14 is readily determined by visual observation. The rotary die plate 14 is placed and held on the die cylinder 26 and marked in specific locations where the receiving holes 30 in the die cylinder 26 align with the die plate 14 and, thus, where the mounting holes 34 are required to be placed. The rotary die plate 14 is then removed from the die cylinder 26 and the mounting holes 34 drilled or otherwise formed in the die plate 14. After the mounting holes 34 are formed in the die plate 14, the die plate 14 is repositioned on the die cylinder 26 and secured thereto.

As shown in FIG. 4, the rotary cutting machine 28 also includes an opposing cylinder 36 positioned parallel to and in opposite rotary relationship with the die cylinder 26. When the rotary cutting machine 28 is in operation, the opposing cylinder 36 rotates counter to the die cylinder 26. During operation of the rotary cutting machine 28, cutting material, such as paper, cardboard or paperboard, is fed between the die cylinder 26 and the opposing cylinder 36. The cutting rule 12 in the rotary die plate 14, which is mounted on the die cylinder 26, and the opposing cylinder 36 cooperate to cut, score or perforate the cutting material in the pattern of the cutting design 21.

Figure 5:
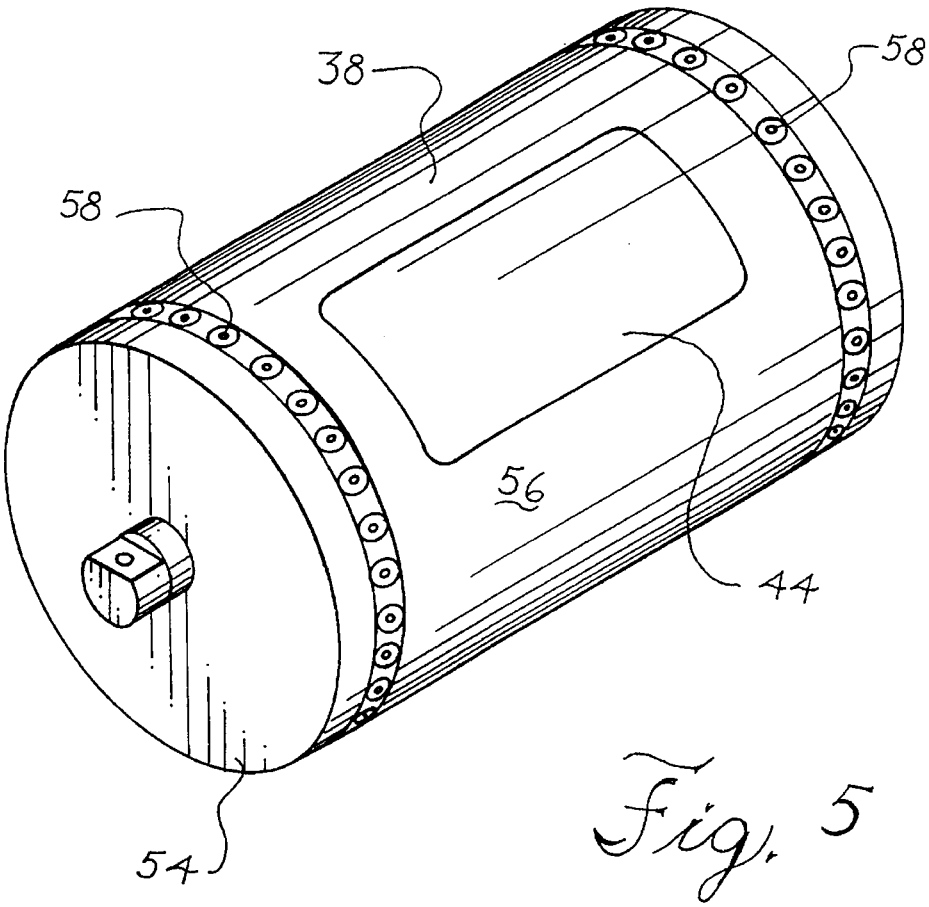
FIG. 5 is a perspective view of the transfer plate material disposed along a cutting cylinder.
Figure 6:
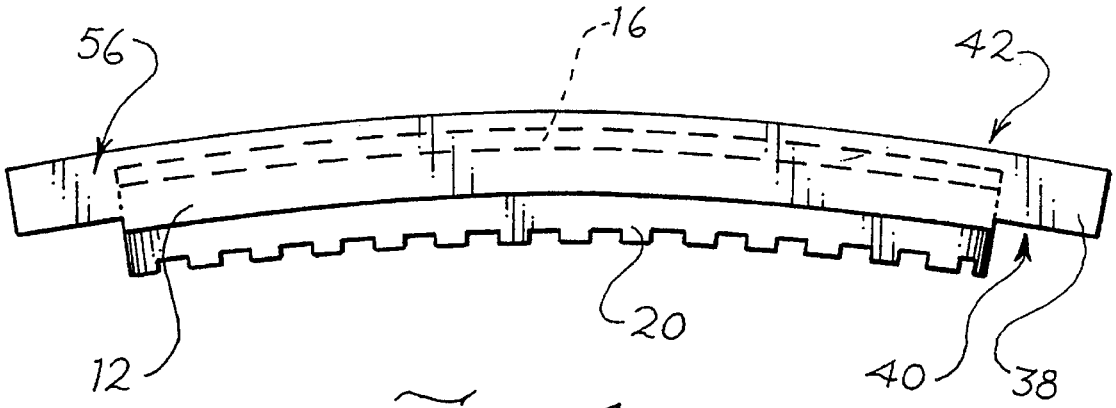
FIG. 6 is a side view of the transfer plate showing the cutting rule positioned therein.

A method for forming the rotary cutting die 10 of the present invention is described below. As shown in FIGS. 5 and 6, a curved cutting rule transfer plate 38, preferably formed of phenolic material 56 and having an inner surface 40 and an outer surface 42, is provided. To insure that the finished rotary cutting die 10 will properly fit and mount to the die cylinder 26, the phenolic material 56 from which the transfer plate 38 is formed is fixedly secured to a cutting cylinder 54 having the same radius of curvature as the die cylinder 26 on the rotary cutting machine 28. Preferably, the phenolic material 56 is fastened to the cutting cylinder 54 by screws 58 or the like. Alternately, the phenolic material 56 may be adhered to the cutting cylinder 54.

A Computer Numeric Controlled (CNC) machine (not shown), which is operatively associated with the cutting cylinder 54 supporting the phenolic transfer plate material 56, cuts the phenolic material 56 to form the transfer plate 38, in a manner generally known in the art. In addition, the CNC machine forms a cutting rule channel 44 in the transfer plate 38 in the pattern of the cutting design 21.

Figure 7:
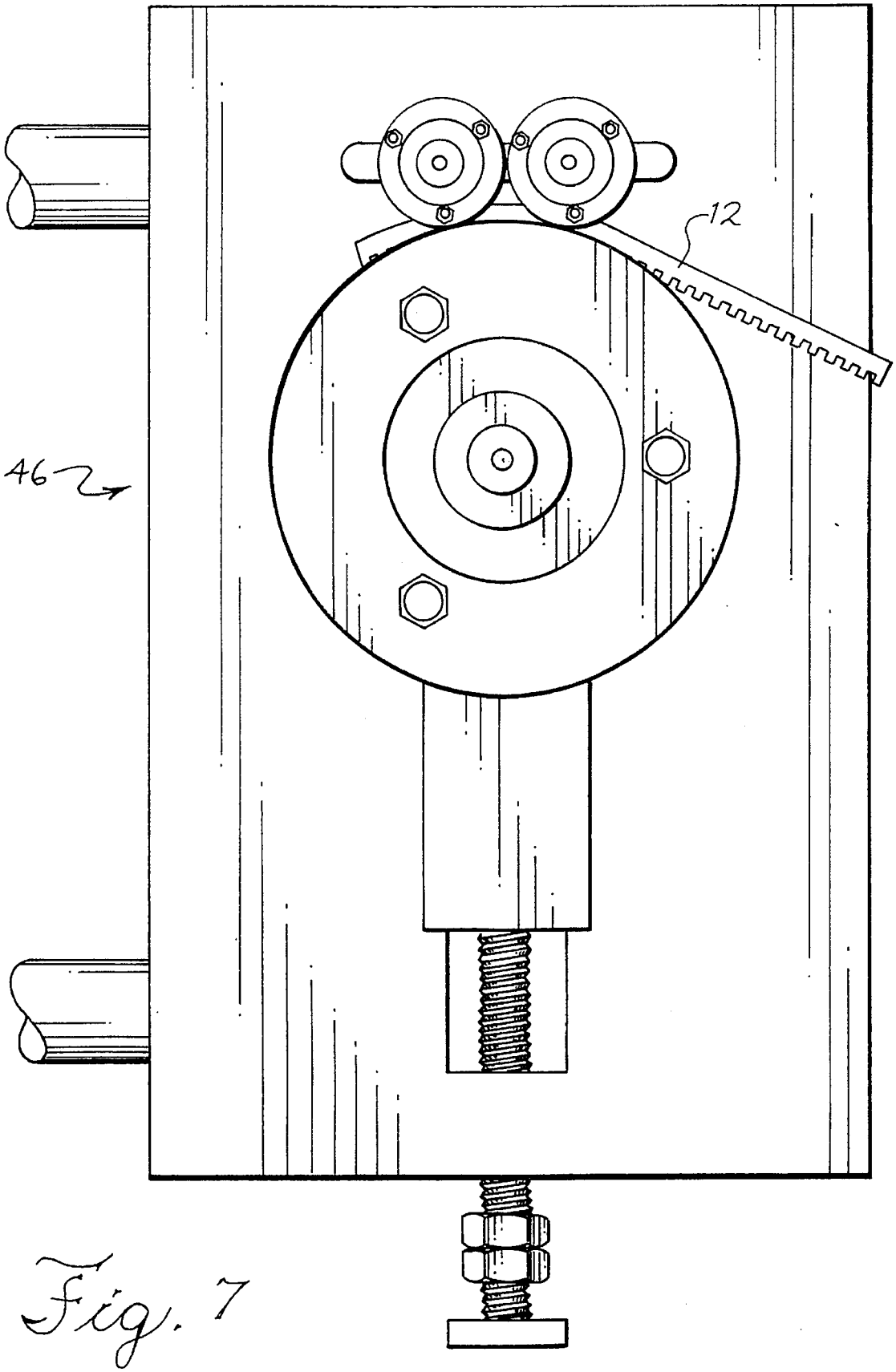
FIG. 7 is an elevational view of a three-roll curver for curving the cutting rule shown in FIGS. 1–3.

As shown in FIG. 7, a three-roll curver 46 is used to bend and shape the cutting rule 12 into the cutting design 21 cut into the transfer plate 38. Because the transfer plate 38, and the resulting rotary die plate 14, are curved, the cutting rule 12 must be curved to the same radius of curvature.

Referring back to FIGS. 5 and 6, after the cutting rule 12 is curved in the three-roll curver 46, the cutting edge 16 of the cutting rule 12 is inserted into the inner surface 40 of the transfer plate 38, through the cutting rule channel 44, until the cutting edge 16 is substantially flush with the outer surface 42 of the transfer plate 38. At this point, the support edge 20 of the cutting rule 12 is exposed and extends beyond the inner surface 40 of the transfer plate 38.

As shown in FIG. 8, the curved transfer plate 38 is placed in the rotary cutting die mold 50 with its inner surface 40, and the support edge 20 of the cutting rule 12, exposed. The interlocking connectors 24 are connected to the notches 22 present in the support edge 20, as described above. Consequently, the interlocking connectors 24 are also exposed, as shown in FIG. 8.

After the mold cylinder 52 is lowered onto the inner surface 40 of the transfer plate 38 and the mold 50 is sealed, an epoxy-based die plate material (preferably having a low shrink factor) is injected into the mold 50 at ambient temperature. The epoxy-based material is cured at an elevated temperature until the epoxy hardens and forms the translucent or transparent rotary die plate 14 on the inner surface 40 of the transfer plate 38. Preferably, the die plate material is cured at 180° F., although it is contemplated that various other curing temperatures could be used depending on the particular epoxy-based material and the specific application.

As shown in FIGS. 8 and 9, subsequent to the rotary die plate 14 being formed, the mold cylinder 52 is raised, and the rotary die plate 14 and the transfer plate 38 are removed from the mold 50. The transfer plate 38 is then physically removed from the rotary die plate 14, and the resultant rotary cutting die 10 is formed. The rotary cutting die 10 may now be mounted to the die cylinder 26 for use on the rotary cutting machine 28.

The following materials are suitable for use in the present invention: the cutting rule transfer plate 38 may be formed of phenolic material; and the rotary die plate 14 may be formed of an epoxy-based material having a low shrink factor. Alternately, the transfer plate 38 and the epoxy-based die plate material may be formed of any material suitable for the application.

As can be readily seen, it is contemplated that numerous individual rotary cutting dies may be mounted on a single die cylinder. Most importantly, because the rotary die plate 14 is translucent or transparent, the precise hole alignment required to properly mount the rotary cutting die 10 on the die cylinder 26 can be easily and quickly determined. This accurate hole positioning will result in fewer rotary die plates being ruined and, thereby, will decrease overhead costs.

It should be appreciated that the present invention may be performed or configured as appropriate for the application. The embodiments described above are to be considered in all respects only as illustrative and not restrictive. The scope of the invention is indicated by the following claims rather than by the foregoing description. All changes which come within the meaning and range of equivalency of the claims are to be embraced within their scope.

I claim:

1. A method of forming a rotary cutting die, comprising the following steps:

providing a curved cutting rule transfer plate comprising an inner surface and an outer surface;

forming a cutting rule channel in the transfer plate, the cutting rule channel defining a predetermined design;

placing a cutting rule having a cutting edge and a support edge in the cutting rule channel, the support edge of the cutting rule extending from the inner surface of the transfer plate;

forming a translucent rotary die plate on the inner surface of the transfer plate wherein the support edge of the cutting rule extends into and is supported in the rotary die plate; and removing the transfer plate from the rotary die plate.

2. The method of claim 1 wherein the cutting rule is bent and shaped to fit within the design formed by the cutting rule channel.

3. The method of claim 2 wherein the cutting rule is bent in a three-roll curver to fit within the design formed by the cutting rule channel.

4. The method of claim 1 wherein the support edge of the cutting rule comprises a plurality of notches.

5. The method of claim 4 wherein the notches are key-hole shaped notches.

6. The method of claim 4 wherein a plurality of interlocking connectors are connected to the notches in the cutting rule, the interlocking connectors operable to reinforce the rotary die plate and to further support the cutting rule in the rotary die plate.

7. The method of claim 6 wherein the interlocking connectors are S-shaped hooks.

8. The method of claim 1 wherein the cutting edge of the cutting rule extends about ⅛" above the rotary die plate.

9. The method of claim 1 wherein the transfer plate is comprised of phenolic material.

10. The method of claim 1 wherein the rotary die plate is comprised of an epoxy-based material that exhibits a low shrink factor.

11. The method of claim 1 wherein the rotary die plate is transparent.

12. The method of claim 1 wherein the step of forming the translucent rotary die plate comprises the steps of:

placing the curved transfer plate in a mold;

exposing the inner surface of the transfer plate;

injecting die plate material into the mold;

causing the die plate material to contact the inner surface of the transfer plate; and curing the die plate material to form the rotary die plate.

* * * * *